US005181154A

United States Patent [19]

Haupt et al.

[11] Patent Number: 5,181,154

[45] Date of Patent: Jan. 19, 1993

[54] CIRCUIT ARRANGEMENT FOR OPTIMAL CURRENT GENERATION IN PROCESSES OF ELECTROCHEMICALLY INITIATED PLASMA-CHEMICAL LAYER PRODUCTION

[75] Inventors: Jens Haupt; Kirstin Haupt; Henry Hornhauer, all of Jena, Fed. Rep. of Germany

[73] Assignee: Jenoptik GmbH, Jena, Fed. Rep. of Germany

[21] Appl. No.: 861,913

[22] Filed: Apr. 1, 1992

[30] Foreign Application Priority Data

Apr. 8, 1991 [DE] Fed. Rep. of Germany ... 9104200[U]

[51] Int. Cl.[5] ..... H01G 1/10; C25D 17/00

[52] U.S. Cl. ..... 361/17; 204/228

[58] Field of Search ..... 204/228; 324/65 R; 361/15, 17, 92

[56] References Cited

U.S. PATENT DOCUMENTS 3,781,911 12/1973 Davidson ..... 324/65 R
4,849,849 7/1989 Zucker et al. ..... 361/92
5,007,993 4/1991 Hull et al. ..... 204/228

*Primary Examiner*—Donald A. Griffin
*Attorney, Agent, or Firm*—McAulay Fisher Nissen Goldberg & Kiel

[57] ABSTRACT

A circuit arrangement for current supply in processes of electrochemically initiated plasma-chemical layer production. It is preferably applied in the plasma-chemical conversion of electrochemically pre-formed layers, e.g. on light metals. The output of the adjustable three-phase transformer with subsequently connected 6-pulse rectifier circuit is branched twice, wherein a first bridge circuit comprises a capacitor connected in parallel to a voltage sensor. A second bridge circuit contains a free-wheeling diode parallel to the current limiting choke and the bath for process implementation. A pulse analyzer is arranged parallel to the latter, and the two bridge circuits are separated by a switch element. An optoelectronic sensor which is connected with the control unit, as is the pulse analyzer, the voltage sensor and a current sensor, is introduced for indicating the pulsed plasma discharges controlled by the circuit arrangement, wherein the control unit influences the switch element with the three-phase transformer in a directed manner to optimally adjust the pulse frequency and duty factor.

2 Claims, 3 Drawing Sheets

CIRCUIT ARRANGEMENT FOR OPTIMAL CURRENT GENERATION IN PROCESSES OF ELECTROCHEMICALLY INITIATED PLASMA-CHEMICAL LAYER PRODUCTION

BACKGROUND OF THE INVENTION a) Field of the Invention

The invention is directed to an arrangement for optimal current generation in processes of electrochemically initiated plasma-chemical layer production. Above all, it is applicable in the plasma-chemical conversion of electrochemically pre-formed layers, e.g. on light metals or their alloys.

b) Background Art

It is generally known that plasma-chemical processes can take place as parasitic processes in the formation of electrolyte capacitors with direct voltage. The patents DD 142 360, DE-OS 23 60 630 and DE-OS 23 60 688 describe the deliberate use of this effect in forming or reforming electrolyte capacitors. After a forming voltage passes through, which is material-dependent and often less than 100 V, the direct voltage is increased until the plasma discharge is initiated. A disadvantage in this solution consists in that the produced layers have considerable roughness and different layer thickness.

To eliminate such disadvantages it was suggested in U.S. Pat. No. 4,868,789 to carry out the process of electrochemically initiated plasma-chemical layer production with pulsed current.

The use of devices for producing current or voltage pulses is known for a number of electrochemical processes of varying complexity, e.g.

for electroplating—DE-OS 25 41 528; DE-OS 26 04 628
for anodizing/anodic oxidation—DE-OS 33 05 355
for electrolytic etching—DE-OS 15 64 486
for forming capacitor foils—DE-OS 14 89 695
for electrical discharge machining—U.S. Pat. No. 4,776,281

A series of technical principles are known for the construction of pulse systems. One variant is line-commutated current inverters without an intermediate d.c. circuit and energy storage according to the principle of phase control, e.g. for controlling motors of all performance classes or for lighting and heating systems. The disadvantage of this solution for use in electrochemically initiated plasma-chemical layer production consists in the dependency of the curve shape of the output voltage on the pulse magnitude selected in each instance;
the rigid linking of the frequency of the output voltage with the mains frequency;
the interdependence of the duty factor and pulse voltage; and
the uneven, unfavorable mains load, although the elimination of interference in such current inverters on the line side is viewed as technically solved.

Another variant for the construction of pulse systems consists in master-controlled current inverters with an intermediate d.c. circuit. The disadvantages of the above variants can accordingly be overcome.

In order to produce pulses of different pulse voltage or current from a voltage fixed by the main rectification, it is necessary to use storage elements (generally inductances, sometimes also in combination with capacitors), e.g. blocking converters as are described in DE-OS 3 040 481. They are used to produce a d.c. voltage supply after rectification and smoothing of the pulses (switching network circuits).

Disadvantages result when applied in electrochemically initiated plasma-chemical layer production. These include the occurrence of very different load ratios. For this reason the energy coupled into the inductance must be made dependent on the load ratios. This necessarily leads to an operating frequency which is dependent on the load to a great extent, a different duty factor, and a coating technology which is not reproducible in an exact manner. Further, the coating parameters can be freely selected only to an extremely limited degree. Still further, the time curve of current and voltage cannot be compensated for during short-term load fluctuations such as are known to occur in this process. Even further, there is no assurance of a limiting of the voltage peaks occurring in the pulse and local defects in the layer are unavoidable for this reason. Finally, the voltage peaks occurring in operation lead to increased demands on the switch elements (high current load capability in connection with high voltage strength).

It is known from verbal communications of the Technical University of Chemnitz to dispense completely with a conversion in processes of electrochemically initiated plasma-chemical layer production and to apply alternating current or three-phase current directly to the electrode system. Disadvantages in this solution are particularly:

the use of fixed frequencies already mentioned in the first variant of the construction of pulse systems;
the very high, necessary symmetry requirements for the utilized electrodes (identical parts with identical preliminary treatment); and
the poor reproducibility of the layers due to disproportionation effects.

Accordingly, this method is generally unsuited for precision parts in precision device technology.

It should be noted that the electrical process implementation in electrochemically initiated plasma-chemical layer production is handled very differently and was inadequately incorporated into the evaluation of the produced layers. In addition to the characteristic of the utilized electrolyte systems, however, it is the second most substantial influencing variable on the process of electrochemically initiated plasma coating. It is generally known that two process steps exist which pass from one to the other through an increase in the electrode voltage. The first step is the so-called forming phase which is a purely electrochemical process and usually proceeds at voltages of less than 100 V. At higher voltages, plasma discharges occur accompanied by the formation of sparks which realize the actual layer formation. The particular disadvantage consists in the empirical character of the previously known strategies for conducting the process which impedes the determination of defined technological conditions.

SUMMARY OF THE INVENTION

The invention is based on the problem of providing a circuit arrangement for the continuous supply of current in processes of electrochemically initiated plasma-chemical layer production which enables the production of layers without local defects with good reproducibility and under-defined technological conditions. This circuit arrangement is to be self-optimizing and to minimize the main reactions and asymmetry.

In accordance with the invention, a circuit arrangement for the current supply in processes of electrochemically initiated plasma-chemical layer production comprises a controllable direct voltage source, a bath for the process implementation and respective control electronics, and an adjustable three-phase transformer with a subsequently connected 6-pulse rectifier circuit which is employed as a controllable direct voltage source. The adjustable three-phase transformer carries a control input and the 6-pulse rectifier circuit carryies a control output on the current side and an output on the current sink side. The output on the 6-pulse rectifier circuit on the current source side contacts the output of the 6-pulse rectifier circuit on the current sink side by way of a current limiting choke, by way of the bath for process implementation connected in parallel with a pulse analyzer, by way of a switch element and by way of a current sensor. The output of the 6-pulse rectifier circuit on the current source side is branched device as a bridge circuit with its output on the current sink side. The first bridge circuit comprises a parallel connected capacitor with a voltage sensor and contacts the output of the 6-pulse rectifier circuit on the current source side between the switch element and the current sensor by way of a junction. The second bridge circuit which contains a freewheeling diode, contacts the input of the current limiting choke after the junction and between the switch element and parallel connection of the pulse analyzer with the bath for process implementation. An optoelectronic sensor is assigned to the bath for the process implementation. An additional output of the pulse analyzer, the optoelectronic sensor, the voltage sensor and the current sensor, respectively, contact inputs of the control electronics. Control electronics are assigned to the adjustable three phase transformer. An output of the control electronics contacts the switch element. In a preferred construction the capacitor is in the form of an electrolyte capacitor.

In contrast to the conventionally known solutions, the invention achieves an economically feasible solution for continuous current supply in processes of electrochemically initiated plasma-chemical layer production and concurrently the production of layers without local defects, with good reproducibility and under defined technological conditions.

For a better understanding of the present invention, reference is made to the following description and accompanying drawings while the scope of the invention will be pointed out in the appended claims.

BRIEF DESCRIPTION OF THE DRAWINGS

In the drawings:

FIG. 2*a* illustrates a time curve of voltage and FIG. 2*b* illustrates a time curve of current.

DESCRIPTION OF THE PREFERRED EMBODIMENTS

Figure 1:
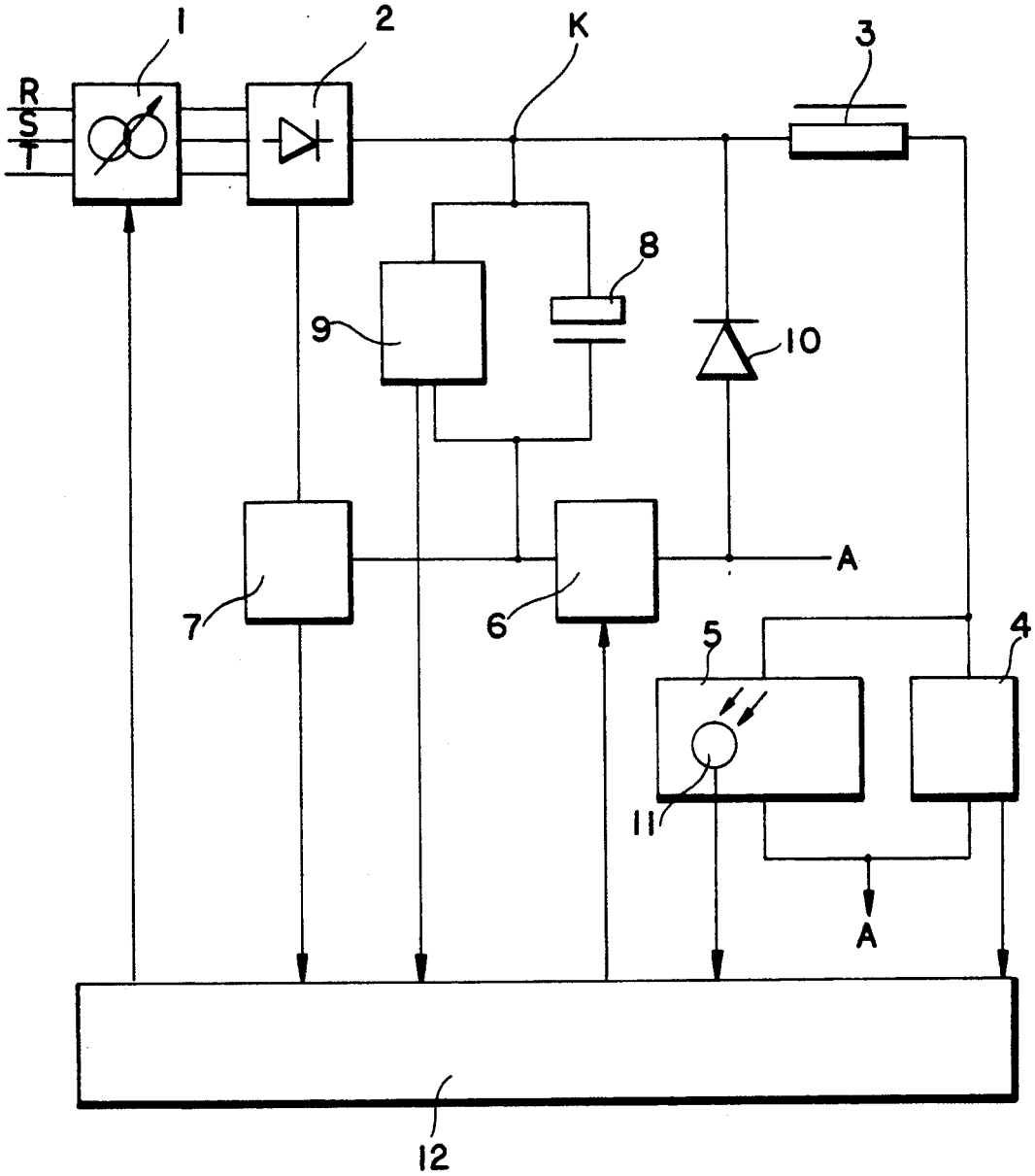
FIG. 1 shows the basic wiring diagram of the circuit arrangement according to the invention.

In FIG. 1, an adjustable three-phase transformer 1 with a control output and subsequently connected 6-pulse rectifier circuit 2 is arranged as controllable direct voltage source with an output on the current source side and an output on the current sink side. The output of the 6-pulse rectifier circuit 2 on the current source side contacts the output of the 6-pulse rectifier circuit 2 on the current sink side via a current limiting choke 3, a pulse analyzer 4 which is connected in parallel to the bath for the process implementation 5, by way of a switch element 6 and by way of a current sensor 7. Moreover, the output of the 6-pulse rectifier circuit 2 at the current source side is branched twice as a bridge circuit with its output on the current sink side. The first bridge circuit, which comprises a capacitor 8 connected in parallel to the voltage sensor 9, contacts the output of the 6-pulse rectifier circuit 2 on the current source side by way of a junction K and by way of the other junction between the switch element 6 and the current sensor 7. The second bridge circuit which contains a freewheeling diode 10 contacts the input of the current limiting choke 3 after the junction K and prior to the switch element 6. An optoelectronic sensor 11 is assigned to the bath 5 for the process implementation. An additional output of the pulse analyzer 4, the optoelectronic sensor 11, the voltage sensor 9 and the current sensor 7, respectively, contacts inputs of the control electronics 12. The control electronics 12 are assigned to the three-phase transformer 1 and an output is connected to the switch element 6. An electrolyte capacitor 8 is preferably used as capacitor.

Figure 2A:
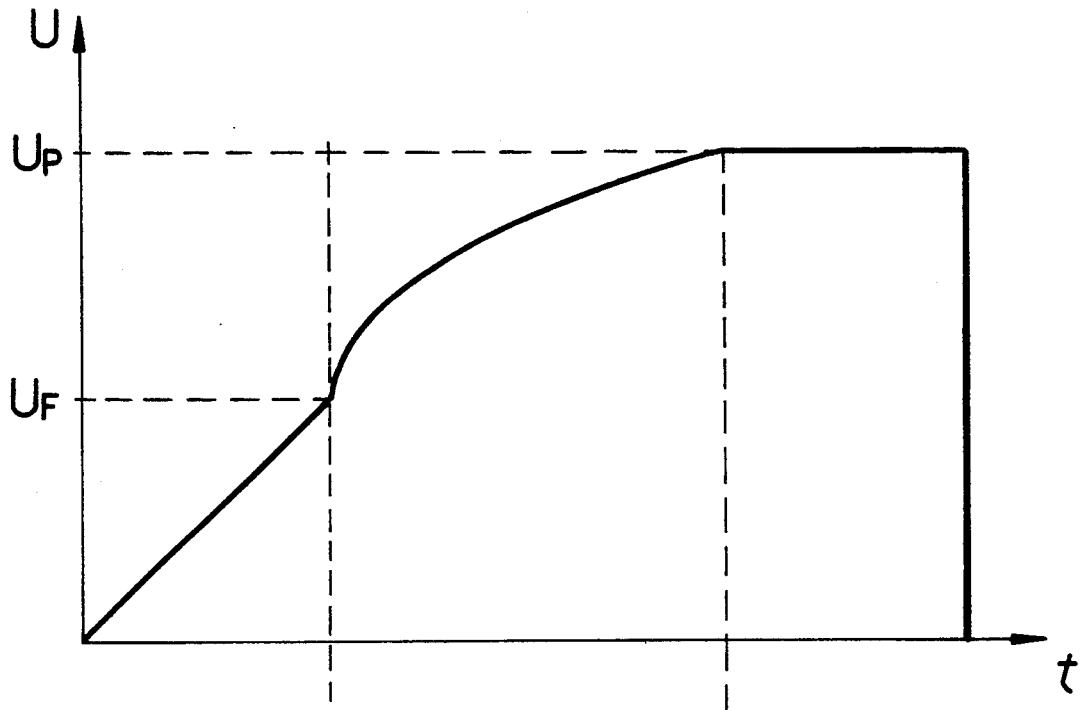
FIGS. 2*a* and 2*b* show the effect of the circuit in the diagrams.
Figure 2B:
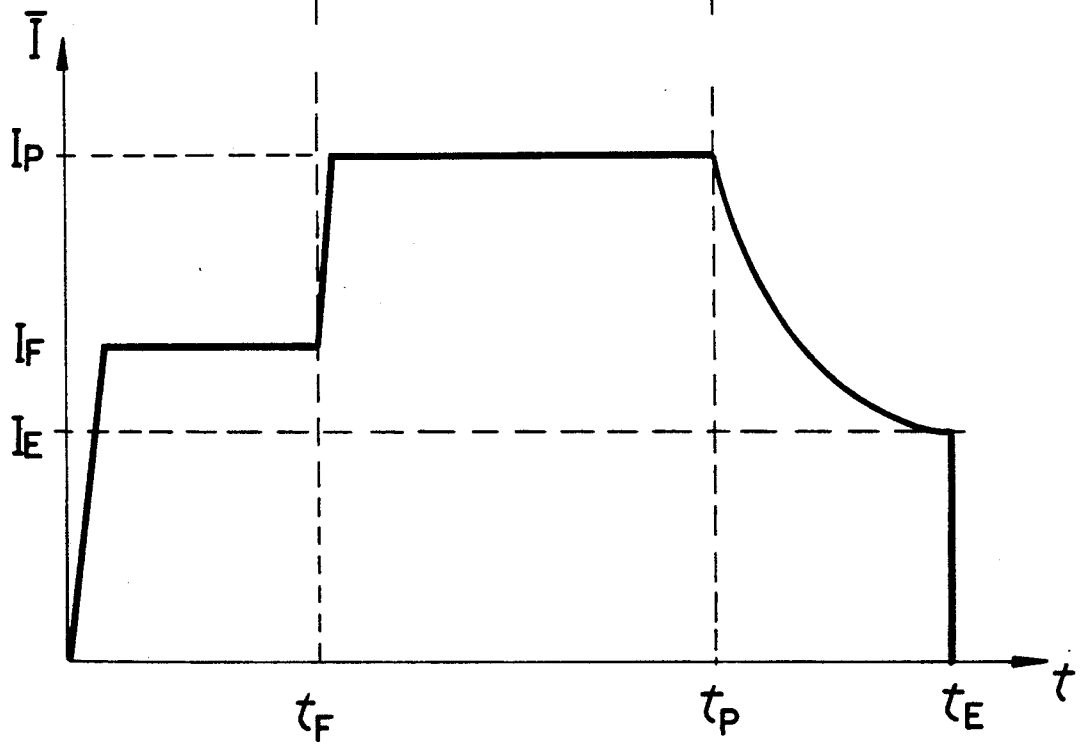

The circuit works in the following manner and is explained in more detail with respect to the diagrams in FIGS. 2*a* and 2*b*. The controllable direct voltage source is designed as an adjustable three-phase transformer with subsequently connected 6-pulse rectifier circuit 2. A controllable direct voltage of 0 V to 500 V is accordingly produced with low residual ripple and at low cost. The control of the servomotor is assumed by the control electronics 11.

A switch-on time $t_{on}=10$ ms$>t_{on}20$ μs is determined for the switch element 6 as a function of the selected electrolyte with the material to be coated. With a voltage increase rate $$\frac{dU}{dt} = 5\ \mathrm{V}\cdot s^{-1} > \frac{d\overline{U}}{dt} > 0.2\ \mathrm{V}\cdot s^{-1},$$

a direct voltage increasing linearly from 0 V is produced by the adjustable three-phase transformer 1 and the 6-pulse rectifier circuit 2 which effects the forming process. It is possible to switch off the pulse control of the switch element 6 and the operation of the bath for the process implementation 5 with direct current, but this does not prove advantageous. The voltage increase rate $d\overline{U}/dt$ is selected in such a way that the average current densities I/A are realized between 0.005 $A\cdot cm^{-2}$ and 0.5 $A\cdot cm^{-2}$. At a given voltage increase rate $d\overline{U}/dt$ the adjusted forming current $I_F$ is a measure for the effective surface and can therefore be made use of in the relation $I_p=\mathrm{const}\cdot I_F$ for the actual coating process for determining the optimal operating current $I_P$ during the plasma discharges. When the time point $t_F$ for the forming time is reached, distinguishably at the commencement of the spark discharges—registration by the optoelectronic sensor 11 in the NIR region in which most electrolytes are transparent or when the voltage $\overline{U}_F$ maximum forming voltage without plasma discharge is reached, the direct voltage is controlled in such a way that the constant average current $I_P$ is constantly adjusted. This leads to the increase in the voltage until the selected final value which lies between 180 V and 500 V depending on the material and layer thickness. After this time $t_P$=time of plasma discharges at constant current, the voltage is kept constant until the current has been damped to the preselected final value IE=breaking current intensity which lies between 10% and 80% of the value $I_P$. The voltage source is then switched off and the coating process is ended. The control electronics 12 ensure that this control regime is worked out.

The following protective functions are incorporated in addition:

1. By evaluating the output signal of the current sensor 7, the switch element 6 is locked when a critical current value (short circuit or overload) is exceeded; the reduction in the direct voltage produced by the three-phase transformer 1 is effected simultaneously. After eliminating the cause of error, the system is started again.

2. When the contacting of the workpiece is defective, a stable current conduction and accordingly a correct layer production cannot be guaranteed. Moreover, an extreme loading of the switch element 6 occurs when the contact is suddenly reinitiated under conditions of an increased voltage. When this type of disturbance is indicated by the current sensor 7, the switch element 6 is likewise locked and the voltage is reduced. After the cause of error is eliminated, the system is started again. The frequencies and duty factor of the control signal for the switch element 6 are optimized according to the following criteria The frequency should be other than 1 kHz for physiological reasons in order to keep the subjective switching impression as slight as possible while the process is being carried out. On the other hand, an improvement in the layer characteristics is to be noted when the frequency is increased up to a system-dependent limiting value, since a "burn-in effect" is avoided by frequently extinguishing the plasma discharge.

Figure 3:
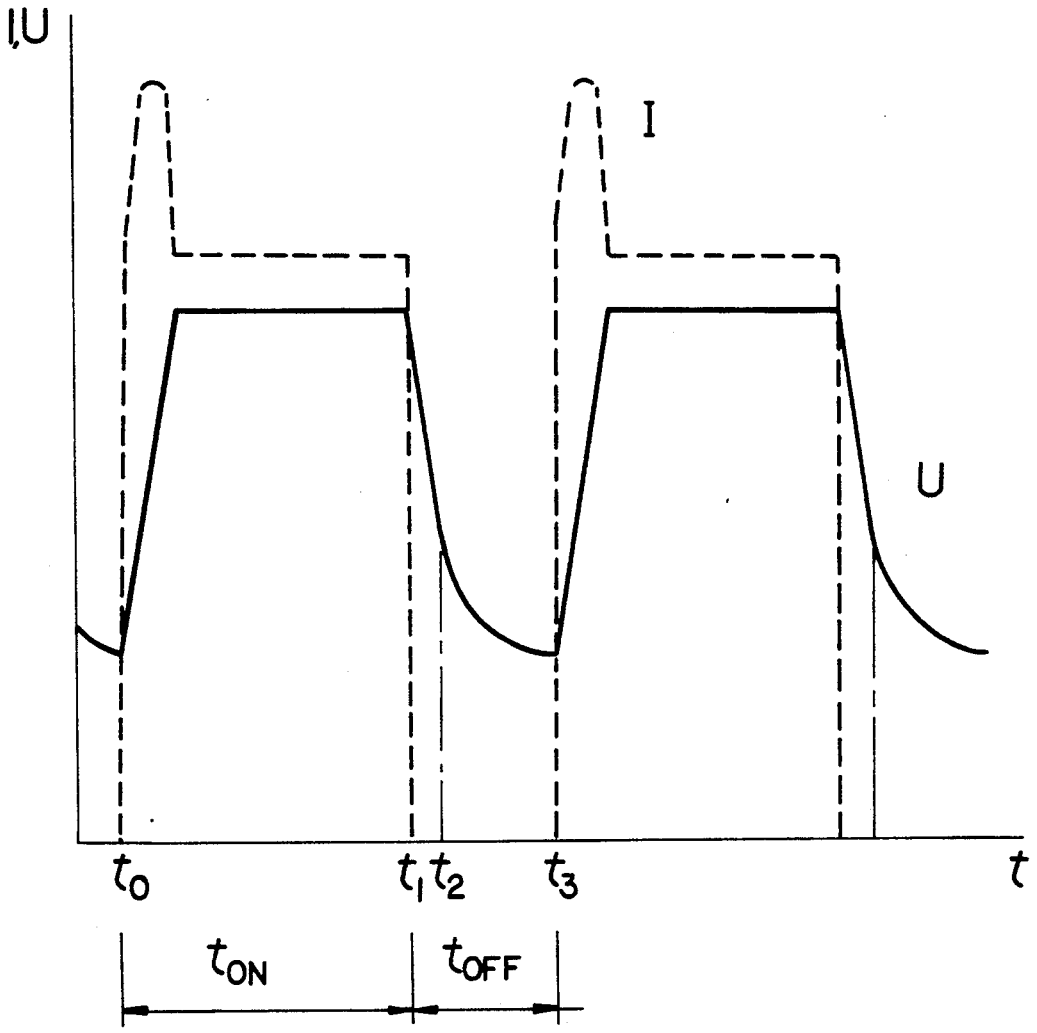
FIG. 3 shows the time curve of current and voltage in the bath circuit in the quasi-stationary case.

The selection of the duty factor and the individual partial times is explained with the aid of FIG. 3. FIG. 3 shows the time curve of current and voltage in the bath circuit in the quasi stationary case. When the pulse voltage is switched on at time point $t_0$, an intensive current increase which is limited by the current limiting choke 3 is effected because of the extreme capacitative behavior of such arrangements in electrolytes. A stable pulse current is then adjusted. When time point $t_1$ is reached, the switch element 6 is switched off. The energy stored in the current limiting choke 3 is converted in the system via the freewheeling diode 10 and the system capacity is very quickly discharged to a value at which the plasma discharges are interrupted, time point $t_2$=energy degradation of the electrochemical system ended, transition to the parasitic discharge of the "electrolyte capacitor" of the system. At time point $t_3$ the cycle is started again.

The time period $t_{off}$ must be selected in such a way that the plasma discharges are reliably quenched. The optoelectronic sensor is used for indicating the extinguishing of the plasma discharges. The output signal of the pulse analyzer 4 is likewise used. In the event of available knowledge concerning the current time curves in the system with respect to the utilized electrolyte work material pairing, the optoelectronic sensor and the pulse analyzer 4 can be dispensed with.

The time period $t_{on}$ determines the maximum possible energy conversion and the attainable frequency. The two quantities react oppositely. While a greater layer growth is to be noted at increased energy conversion, the higher frequency leads to qualitatively better layers.

A pulse frequency of 500 Hz is selected and a duty factor of 1:4 is adjusted for coating an aluminum work material by electrochemically initiated plasma-chemical layer production. For regulating, the value of 0.09 $A \cdot cm^{-2}$ is applied as critical current density; the coating final voltage is 300 V. After the current density is reduced to less than 0.01 $A \cdot cm^{-2}$ the pulse voltage is switched off. The produced layer has an extremely fine morphology with a layer thickness of 17 μm which has outstanding optical and vacuum-hygienical characteristics.

While the foregoing description and drawings represent the preferred embodiments of the present invention, it will be obvious to those skilled in the art that various changes and modifications may be made therein without departing from the true spirit and scope of the present invention.

What is claimed is:

1. Circuit arrangement for the current supply in processes of electrochemically initiated plasma-chemical layer production comprising:

a controllable direct voltage source;

a bath for the process implementation and respective control electronics;

an adjustable three-phase transformer with a subsequently connected 6-pulse rectifier circuit being employed as a controllable direct voltage source, wherein the adjustable three-phase transformer carries a control input and the 6-pulse rectifier circuit carries a control output on the current source side and an output on the current sink side;

said output of the 6-pulse rectifier circuit on the current source side contacting the output of the 6-pulse rectifier circuit on the current sink side by way of a current limiting choke, by way of said bath for process implementation connected in parallel with a pulse analyzer, by way of a switch element and by way of a current sensor;

said output of the 6-pulse rectifier circuit on the current source side being branched twice as a bridge circuit with its output on the current sink side;

wherein the first bridge circuit, comprising a parallel connected capacitor with a voltage sensor, contacts the output of the 6-pulse rectifier circuit on the current source side between the switch element and the current sensor via a junction; and wherein the second bridge circuit, which contains a freewheeling diode, contacts the input of the current limiting choke after said junction and between the switch element and parallel connection of the pulse analyzer with the bath for process implementation;

an optoelectronic sensor being assigned to the bath for the process implementation;

an additional output of the pulse analyzer, the optoelectronic sensor, the voltage sensor and the current sensor, respectively, contacting inputs of the control electronics;

control electronics being assigned to the adjustable three-phase transformer; and an output of the control electronics contacting the switch element.

2. Circuit arrangement for current generation in processes of electrochemically initiated layer production as in claim 1, wherein said capacitor is an electrolyte capacitor.

* * * * *